US005548258A

United States Patent [19]

Kuboyama et al.

[11] Patent Number: 5,548,258

[45] Date of Patent: Aug. 20, 1996

[54] CIRCUIT BREAKER WITH INSULATION DEVICE

[75] Inventors: Katsunori Kuboyama; Koji Asakawa; Naoshi Uchida, all of Kawasaki, Japan

[73] Assignee: Fuji Electric Co., Ltd., Kawasaki, Japan

[21] Appl. No.: 422,518

[22] Filed: Apr. 14, 1995

[30] Foreign Application Priority Data

Apr. 26, 1994 [JP] Japan ..... 6-110423

[51] Int. Cl.[6] ..... H01H 75/00

[52] U.S. Cl. ..... 335/16; 335/147; 215/22

[58] Field of Search ..... 335/16, 147, 295; 218/22, 24

[56] References Cited

U.S. PATENT DOCUMENTS 4,644,307 2/1987 Tanimoto ..... 335/16
4,835,501 5/1989 Hovanic ..... 335/16
5,321,378 6/1994 Ferullo et al. ..... 335/202

*Primary Examiner*—Lincoln Donovan
*Attorney, Agent, or Firm*—Kanesaka & Takeuchi

[57] ABSTRACT

A circuit breaker with an insulation device is formed of a molded case having side walls to form a chamber, a stationary contact member situated in the chamber and fixed on the molded case, a moving contact member movably connected to the molded case, a U-shaped magnetic driving core attached to the stationary contact member and having a pair of arms projecting outwardly from the stationary contact member, and an insulation cover. The side walls has slots therein, and the arms are situated inside the slots so that the outer surfaces of the arms are covered by the side walls of the molded case. The insulation cover has arm-shaped and board-shaped parts and is attached onto the outer surface of the stationary contact member. The board-shaped part covers the outer surface of the stationary contact member except the contact point, and the arm-shaped parts covers the inner surfaces of the arms of the magnetic driving core so that the inner and outer surfaces of the magnetic driving core are completely covered.

8 Claims, 2 Drawing Sheets

CIRCUIT BREAKER WITH INSULATION DEVICE

BACKGROUND OF THE INVENTION AND RELATED ART STATEMENT

The present invention relates to a circuit breaker, such as molded case circuit breaker and earth leakage breaker, and especially to an insulation device for a magnetic driving core which drives an electric arc toward an arc quenching device.

One of magnetic driving cores and its insulation device were described in the Japanese Laid Open Patent Publication No. H02-132716. This device is comprised of a U-shaped magnetic driving core having a pair of side arms and a connection base between the side arms and attached at an end of a stationary contact member which is bent back to a U shape. The device further comprises an insulation member which is integrally molded with cap parts for covering the side arms of the magnetic driving core, a bottom board part for covering the periphery of the stationary contact member except a stationary contact or the like, and a partition wall disposed between a moving contact member and an inner edge of a cut-off part of grid plates in an arc quenching device.

However, since the insulation member described in the Japanese Laid Open Patent Publication No. H02-132716 above has a shape of a cap, it has following problems;

(1) Since both inner and outer surfaces of the side arms of the magnetic driving core are covered with the cap parts of the insulation member, the side arms including the insulation member are thick. Consequently, if it is attempted to ensure space for right and left side arms wide enough to facilitate moving in and out of a moving contact member, there is a problem that the thickness of the magnetic driving core is limited. Therefore, a satisfactory performance of magnetic driving can not be obtained.

(2) Since the thickness of the cap part of the insulation member is also limited because of the same reason as described above, a satisfactory performance of insulation can not be obtained.

(3) The insulation member in the form of a cap requires a complex mold and a high cost, and work for covering the cap on the side arms is of low workability and requires long working time.

In viewing the foregoing problems, an object of the present invention is to provide an insulation device for a magnetic driving core of a circuit breaker with a satisfactory insulation performance, wherein the thickness of the magnetic driving core is less restricted, a molding is simplified, and a mounting workability is improved.

SUMMARY OF THE INVENTION

The object of the present invention is achieved by a circuit breaker with an insulation device for a U-shaped magnetic driving core, which is comprised of a molded case; a stationary contact member fixed on the molded case; a moving contact member contacted with and separated from the stationary contact member; a pair of arms of the magnetic driving core projecting from the stationary contact member toward an opening direction of the moving contact member; slots disposed in the side walls of the molded case, to which the arms of the magnetic driving core are inserted; and an insulation cover attached onto the stationary contact member, the insulation cover covering a periphery of the stationary contact member together with inner surfaces of the arms of the magnetic driving core.

In the present invention, the arms of the magnetic driving core are put into the side walls of the molded case, so that the outer, front, and rear side surfaces of the arms are insulated by the molded case itself, and the insulation cover covers only the inner surfaces of the arms and the periphery of the stationary contact of the stationary contact member. By this structure, since the insulation cover can be integrally molded as a board form including covering parts for the arms, a space for thickness of the insulation cover at the arms is reduced, so that the thickness of the magnetic driving core can be increased by the reduced thickness of the insulation cover. Therefore, the form of the insulation cover is simplified and work for molding and attaching is facilitated.

DETAILED DESCRIPTION OF PREFERRED EMBODIMENTS

Figure 1:
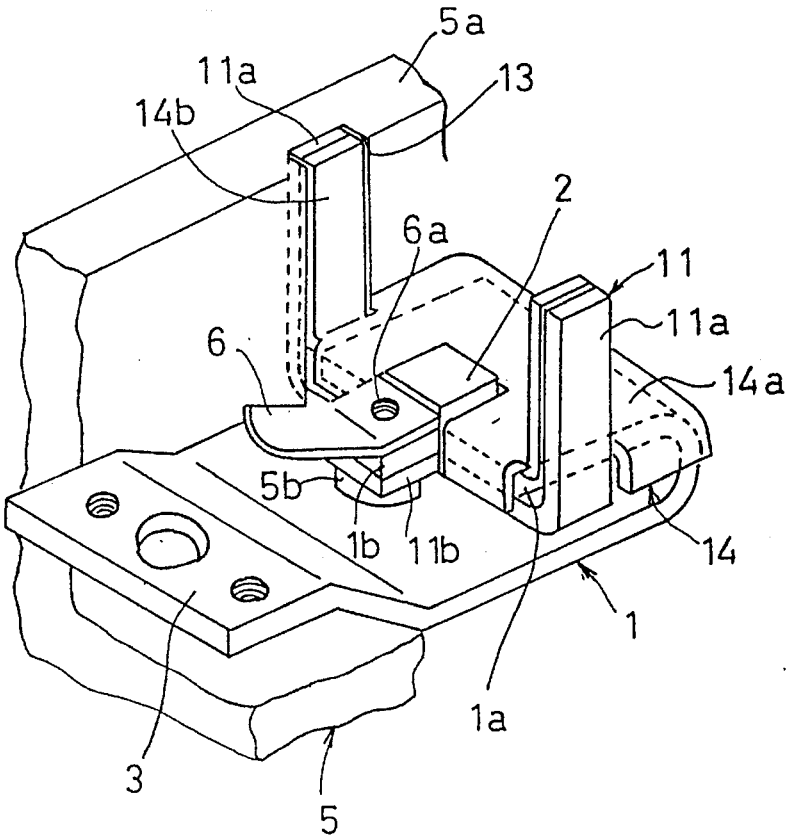
FIG. 1 is a partly cut perspective view of a main part of a stationary contact member of a circuit breaker in the first embodiment of the present invention.
Figure 2:
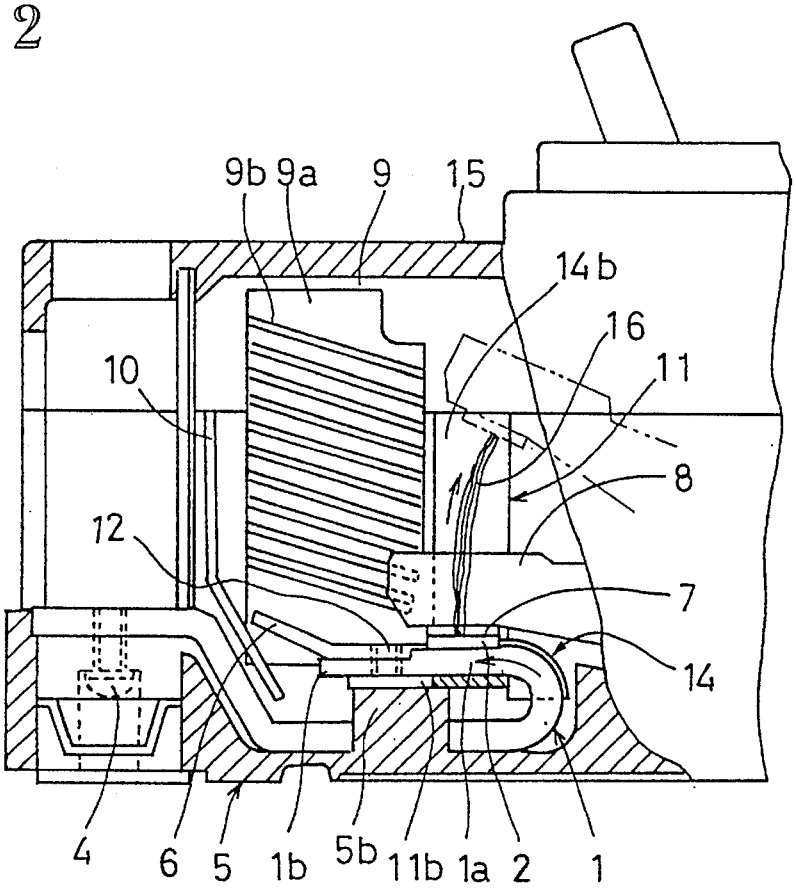
FIG. 2 is an explanatory longitudinal section view of a main part of the circuit breaker in the first embodiment as shown in FIG. 1.

FIGS. 1 and 2 show the first embodiment of the present invention. FIG. 1 shows a partly cut perspective view of a main part, i.e. a stationary contact member of a center pole in a three-pole circuit breaker (molded circuit breaker), and FIG. 2 is an explanatory longitudinal section view of the main part.

In FIGS. 1 and 2, an end 1*a* of a stationary contact member 1 is bent back to a U-shape, and a stationary contact 2 is joined to the stationary contact member 1 at the end 1*a*. The stationary contact member 1 is fixed to a molded case 5 with screws 4 at a power supply terminal 3 formed integrally with the other end of the stationary contact member 1. A square arc horn holder 1*b* having the same width as that of the stationary contact 2 is provided integrally at the end 1*a* of the stationary contact member 1, and an arc horn 6 is attached to the arc horn holder 1*b*.

As shown in FIG. 2, a moving contact member 8 contacts with and separates from the stationary contact member 1 at a moving contact 7. The moving contact member 8 is supported by the molded cover 5 through an insulation holder (not shown) and freely rotatable in a range between a closed position in which the moving member 8 is attached to the stationary contact 2, and an opened position illustrated by a two dotted line in FIG. 2 by using a switching mechanism (not shown). An arc quenching chamber 9 is disposed in front of the moving contact member 8, and comprised of two right and left insulation side walls 9*a* fixed to the molded case 5 and a number of grids 9*b* supported with the insulation side walls 9*a*. In addition, an insulation board 10 is arranged in front of the arc quenching chamber 9.

The magnetic driving core 11 with a U-shape has a pair of arms 11*a* standing upward in the opened position of the moving contact member 8, and is piled at nearly the same position as the stationary contact 2 on the rear surface of the end 1*a* of the stationary contact member 1. The magnetic driving core 11 is fixed together with the arc horn 6 by a screw 12 screwed into a screw hole 6*a* through an attaching piece 11*b* formed in the same shape as the arc horn holder 1*b*. An interior of the molded case 5 defined by right and left side walls (not shown) is separated into three separated chambers by two interphase or partition walls 5*a* for three phase, and each stationary contact member 1 is fixed in each separated chamber as shown in the FIGS. 1 and 2. Slots 13 are disposed on both of opposed side surfaces of the right and left interphase walls 5*a* in the case of the center pole as shown in FIGS. 1 and 2, or on the opposed side surfaces of the interphase wall 5*a* and the side wall of the molded case in the case of right or left pole (not shown). Each arm 11*a* of the magnetic driving core 11 is put into each slot 13 as shown in FIG. 1.

The stationary contact member 1 is attached and covered with an insulation cover 14 of a board shape. The insulation cover 14 molded from a heat resistant resin covers the periphery of the stationary contact 2 of the stationary contact member 1 and inner surfaces of the arms 11*a* of the magnetic driving core 11 integrally. A flat board part 14*a* of the insulation cover 14 for covering the stationary contact member 1 is bent downward as a skirt in front, rear, right and left ends thereof as shown in FIG. 1, so as to cover upper and end surfaces of the stationary contact member 1 near the end 1*a* completely. Further, in the embodiment shown in FIGS. 1 and 2, arms 14*b* of the insulation cover 14 are inserted into the slots 13 together with the arms 11*a* of the magnetic driving core 11, and the inner surfaces of the arms 14*b* are flush with the side surfaces of the interphase walls 5*a* or the side walls of the molded case 5. And upper end surfaces of the arms 11*a* and 14*b* disposed in the slots 13 are flush with upper end surfaces of the molded case 5.

Assembly of the above described parts is performed as follows. After the arc horn 6 and the magnetic driving core 11 are attached to the stationary contact member 1 joined with the stationary contact 2, these parts are inserted into the molded case 5 by fitting the arms 11*a* in the slots 13. Thereafter, a cylindrical projection 5*b* formed at the bottom of the molded case 5 is fitted with a circular hole (not shown) of the stationary contact member 1, and fixed with a screw 12 through the attaching piece 11*b*. Besides, these subassembled parts are also fixed to the molded case 5 at the power supply terminal 3 with the screws 4. After the fixing work, the insulation cover 14 is inserted into the molded case 5 by fitting the arms 14*b* in the slots 13 so as to cover the stationary contact member 1. This insulation cover 14 is fixed by pressing with a molded cover 15 which finally covers the molded case 5.

In such a circuit breaker, when a current flowing along an arrow in FIG. 2 becomes an over-current state to thereby make the circuit breaker tripping, the moving contact member 8 is opened to a position as shown by the two dotted line in FIG. 2, so that an arc 16 is generated between the stationary contact 2 and the moving contact 7. On the other hand, magnetic flux caused by the current flowing through the stationary contact member 1 mostly passes the magnetic driving core 11. Then, the arc 16 is lead toward the arc quenching chamber 9 by the magnetic flux acting between the upper parts of the arms 11*a* so that the act voltage is increased to quench the arc 16. During this process, a bottom part of the arc 16 moves along the arc horn 6 from the stationary contact 2 to a left direction in FIG. 2, but the other parts are insulated from the arc 16 because they are covered with the insulation cover 14.

In the structure shown in FIGS. 1 and 2, since the arms 11*a* of the magnetic driving core 11 are inserted in the slots 13, the outer, front and rear side surfaces of the magnetic driving core 11 are insulated by the molded case 5. And the insulation cover 14 insulates the inner surfaces of the arms 11*a* and the upper surface of the stationary contact member 1. Therefore, the thickness of the insulation cover 14 at the arms 11*a* can be only half as compared with the case of wrapping the arms 11*a* totally with a cap shaped insulator. On the other hand, the thickness of the arms 11*a* can be increased so as to improve the performance of magnetic driving or leading. In addition, since the insulation cover 14 is totally of a board shape, the cost for molding is reduced, and work for attaching the insulation cover 14 to the stationary contact member 1 is facilitated.

Figure 3:
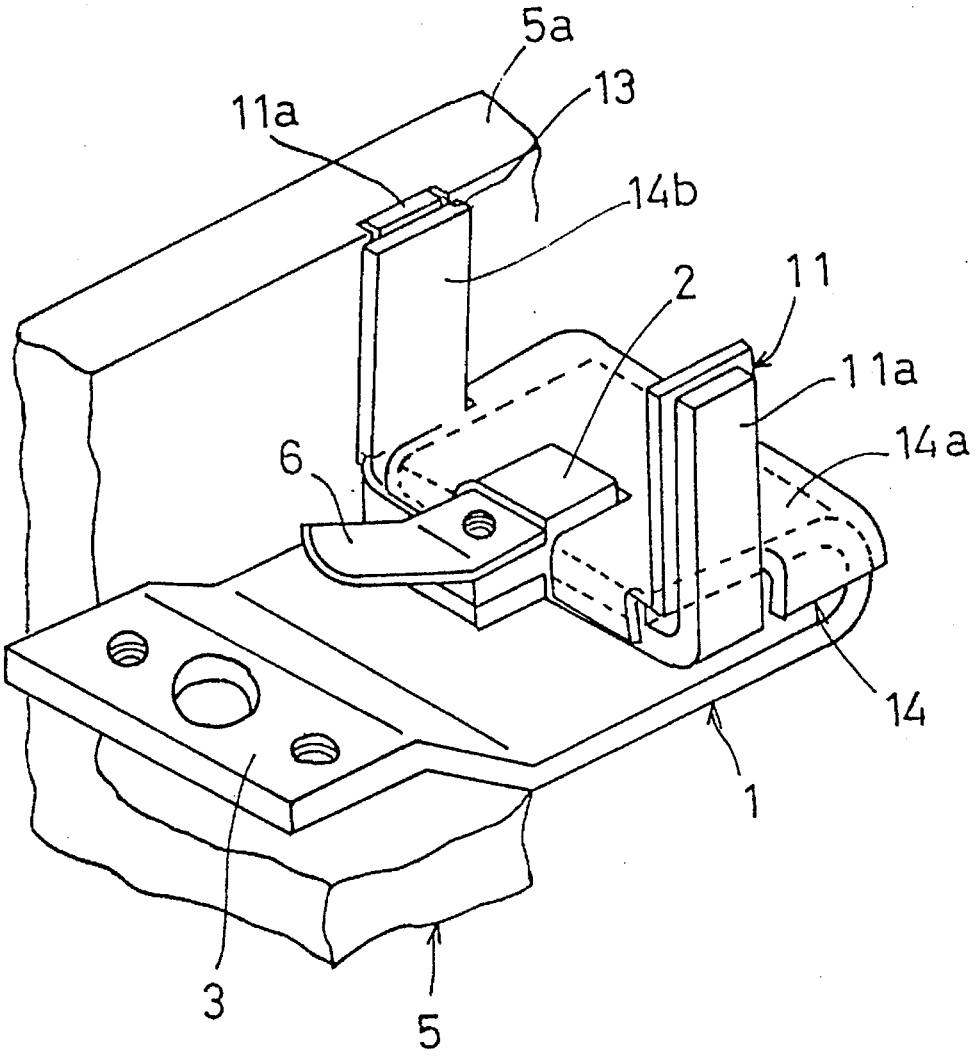
FIG. 3 is a partly cut perspective view of a main part of a stationary contact member of a circuit breaker in the second embodiment of the present invention.

FIG. 3 shows a perspective view of a main part of an insulation device in the second embodiment of the present invention. In this embodiment, only arms 11*a* of a magnetic driving core 11 are put into slots 13 of a molded case 5. The inner surfaces of the arms 11*a* are flush with surfaces of interphase walls 5*a* or side walls of the molded case 5, and arms 14*b* of an insulation cover 14 cover the arms 11*a* along these surfaces. Each width of the arms 14*b* is wider than that of slots 13. Other structures are identical to the first embodiment.

Furthermore, in another embodiment, a cross section of the arms 14*b* of the insulation cover 14 may be made convex, and only the narrow half parts of the arms 14*b* can be put into the slot 13.

According to the present invention, the arms of the magnetic driving core are put into slots disposed on the side surfaces of both side walls of the molded case and insulated with the molded case at the outside, front and rear side surfaces of the magnetic driving core. The periphery of the stationary contact of the stationary contact member and the inner surfaces of the arms of the magnetic driving core are covered with the insulation cover. Therefore, a space for the thickness of the insulation cover at the arms of the magnetic driving core is reduced, so that the performance of the magnetic driving core can be improved by increasing the thickness of the magnetic driving core by the reduced thickness of the insulation cover if a space between the arms of the magnetic driving core is the same as a space between the arms of the insulation cover.

Furthermore, since the insulation cover is molded in a board shape, the molding cost can be reduced and workability for attaching the insulation cover to the stationary contact member is improved.

What is claimed is:

1. A circuit breaker with an insulation device comprising:

a molded case having side walls to form a chamber, said side walls having vertical slots therein, said vertical slots facing and communicating with the chamber and being indented from respective inner surfaces of the side walls;

a stationary contact member situated in the chamber and fixed on said molded case, said stationary contact member having a contact point and an outer surface situated around the contact point and directly facing inwardly of the chamber;

a moving contact member movably connected to the molded case and having a distal end portion for contacting with and separating from said stationary contact member;

a U-shaped magnetic driving core attached to the stationary contact member and having a pair of arms projecting upwardly from said stationary contact member, said arms having inner and outer surfaces and being situated completely inside said slots so that the outer surfaces of the arms are entirely covered by the side walls of the molded case; and an insulation cover having arm portions and a board portion and being attached onto said stationary contact member, said board portion substantially completely covering the outer surface of said stationary contact member except the contact point, said arm portions completely covering the inner surfaces of said arms of said magnetic driving core so that the inner surface of the magnetic driving core and the outer surface of said stationary contact member except the contact point facing inwardly of the chamber are substantially completely covered by the insulation cover.

2. A circuit breaker as claimed in claim 1, wherein a width of the slot is substantially same as that of the arm so that said arm is disposed in the slot securely.

3. A circuit breaker as claimed in claim 2, wherein each arm of the magnetic driving core is only completely located in each slot, and a width of the arm portion of the insulation cover is greater than the width of the arm of the magnetic driving core so that the arm portion contacts the inner surface of the side wall to cover the slot and the arm of the magnetic driving core.

4. A circuit breaker as claimed in claim 2, wherein a width of the arm portion of the insulation cover is same as that of the arm of the magnetic driving core so that the arm portion is completely disposed inside the slot to cover the arm of the magnetic driving core in the slot.

5. A circuit breaker as claimed in claim 4, wherein the stationary contact member includes a U-shaped end so that parts of the driving core are situated under and attached to the U-shaped end.

6. A circuit breaker as claimed in claim 5, wherein the distal end portion of the moving contact member is located in a vicinity of ends of the arms of the magnetic driving core when the moving contact member is separated from the contact point of the stationary contact member.

7. A circuit breaker as claimed in claim 3, wherein said insulation cover further includes edge portions extending perpendicularly to the board portion to cover edges of the stationary contact member.

8. A circuit breaker as claimed in claim 4, wherein said insulation cover further includes edge portions extending perpendicularly to the board portion to cover edges of the stationary contact member.

* * * * *